US005282959A

United States Patent [19]

Roling et al.

[11] Patent Number: 5,282,959

[45] Date of Patent: Feb. 1, 1994

[54] METHOD FOR THE EXTRACTION OF IRON FROM LIQUID HYDROCARBONS

[75] Inventors: Paul V. Roling, Spring; Cato R. McDaniel, The Woodlands, both of Tex.

[73] Assignee: Betz Laboratories, Inc., Trevose, Pa.

[21] Appl. No.: 851,586

[22] Filed: Mar. 16, 1992

[51] Int. Cl.[5] ..... C10G 17/04

[52] U.S. Cl. ..... 208/251 R; 208/252; 208/282; 208/289; 208/291

[58] Field of Search ..... 208/251 R, 252, 282, 208/289, 291

[56] References Cited

U.S. PATENT DOCUMENTS 4,778,590 10/1988 Reynolds et al. ..... 208/252
4,778,592 10/1988 Reynolds et al. ..... 208/252
4,853,109 8/1989 Reynolds ..... 208/252

*Primary Examiner*—Mark L. Bell
*Assistant Examiner*—Walter D. Griffin
*Attorney, Agent, or Firm*—Alexander D. Ricci; Gregory M. Hill

[57] ABSTRACT

A method of extracting iron species from a liquid hydrocarbon medium comprising adding to the medium a composition comprised of an aminocarboxylic acid, methoxypropylamine and a solvent selected from the group consisting of 2-ethylhexanol, cresylic acid, ethylene glycol and hexylene glycol.

2 Claims, No Drawings

METHOD FOR THE EXTRACTION OF IRON FROM LIQUID HYDROCARBONS

FIELD OF THE INVENTION

The present invention relates to the removal of undesirable iron contaminants from liquid hydrocarbons. It is especially helpful to remove iron species from crude oil prior to or during refinery processing.

BACKGROUND OF THE INVENTION

Liquid hydrocarbon mediums, such as crude oils, crude fractions, such as naphtha, gasoline, kerosene, jet fuel, fuel oil, gas oil and vacuum residuals, often contain metal contaminants that, upon processing of the medium, can catalyze undesirable decomposition of the medium or accumulate in the process residue. Accumulation of iron contaminants, like others, is undesirable in the product remaining after refinery, purification, or other processes and, accordingly, diminishes the value of such products.

Similar iron contamination problems are experienced in conjunction with other liquid hydrocarbons, including aromatic hydrocarbons (i.e., benzene, toluene, xylene), chlorinated hydrocarbons (such as ethylene dichloride), and olefinic and naphthenic process streams. All of the above petroleum feedstock and fractions and petrochemicals are referred to herein as "liquid hydrocarbon mediums."

Iron in such liquid hydrocarbon mediums may occur in a variety of forms. For example, it may be present as a naphthenate, porphyrin, or sulfide. In any case, it is troublesome. For example, residuals from iron-containing crudes are used, inter alia, to form graphite electrodes for industry. The value and useful life of these electrodes is diminished proportionately with the level of undesirable iron contamination.

Additionally, in many processes iron-containing catalysts are used which may carry over with the product during purification. Iron catalyst contaminated product leads to deleterious effects.

RELATED ART

It is well known that inorganic acids, at low pHs, will extract organic phase dissolved species into the water phase.

In Reynolds U.S. Pat. No. 4,853,109, it is taught that dibasic carboxylic acids, including oxalic acid, are added to a hydrocarbon feedstock in the form of an aqueous solution comprising the oxalic acid. In this disclosure, the oxalic acid is dissolved in water and then added to the crude. Separation of the w/o emulsion so formed is usually achieved in a desalter although countercurrent extraction techniques are also mentioned.

Other prior art patents that may be of interest include: U.S. Pat. No. 4,276,185 (Martin) disclosing methods of removing iron sulfide deposits from surfaces by using, inter alia, oxalic or citric acid; and U.S. Pat. No. 4,548,700 (Bearden et. al.) disclosing a slurry hydroconversion process in which a hydrocarbon charge is converted to a hydroconverted oil product. In Bearden et. al., a heavy oil portion of the products is separated and partially gassified to produce a carbon-free metal-containing ash that is extracted with oxalic acid. The resulting metal containing oxalic acid extract is recycled to the hydroconversion zone as catalyst precursor.

SUMMARY OF THE INVENTION

The present invention provides enhanced iron removal from liquid hydrocarbons by the use of an amino carboxylic acid and methoxypropylamine (MOPA) dissolved in a select group of hydroxyl containing solvents.

DETAILED DESCRIPTION OF THE INVENTION

Amino carboxylic acids are substantially insoluble in oil. We have discovered that by blending certain members of this group with MOPA into a specific solvent, iron contaminant removal from the hydrocarbon medium is enhanced.

The amino carboxylic acids useful according to the present invention may be defined as having the structure:

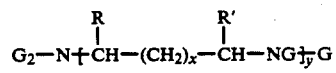

where $G=CH_2COOH$, x=0 or 1, y=0 or 1 and R and R' may be the same of different and are H, alkyl or alkylene groups. Examples of such acids include ethylenediamine tetraacetic acid (EDTA, where R=R'=H, x=0, y=1), nitrilotriacetic acid (NTA, where y=0), (1,2-pyropylenedinitrilo)-N,N,N',N'-tetraacetic acid ($R=-CH_3$, R'=H, x=0, y=1), (1,3-pyropylenedinitrilo)-N,N,N',N'-tetraacetic acid (R=R'=H, x=1, y=1), (2,3-butylenedinitrilo)-N,N,N',N'-tetracetic acid ($R=R'=-CH_3$, x=0, y=1) and 1,2-diaminocyclohexane-N,N,N',N'-tetraacetic acid (R and $R'=CH_2CH_2CH_2CH_2$, x=0, y=1). The preferred amino carboxylic acids are EDTA and NTA.

The formulation of the composition of the invention comprises about 2 to 20 weight percent of amino carboxylic acid based on the total composition. The amount of MOPA present in the inventive formulation will be about 3 to 30 weight percent based on the total composition.

The remainder of the composition comprises a hydroxyl containing solvent. Those solvents meeting the necessary requirement of being able to dissolve the MOPA:EDTA (or NTA) complex were found to be 2-ethylhexanol, cresylic acid, ethylene glycol and hexylene glycol.

Other solvents were tested for their ability to dissolve the MOPA/EDTA (or NTA) complex. Those include methyl t-butyl ether, isopropyl alcohol, acetonitrile, sulfolane, diglyme, triglyme, heavy aromatic naphtha and N-methylpyrrolidone. None of these other solvents exhibited the ability to dissolve, either partially or fully, the complex.

The ability of the amine (MOPA) and the amine carboxylic acid to become solubilized by the solvent is a critical element in the effective functioning of the present invention. Other amines were blended with EDTA (approximately 10% by weight) and attempts were made to dissolve the blend into one or more of the solvents disclosed above as being able to dissolve the MOPA/amino carboxylic acid blend. Table I shows the results.

TABLE I

| Solvent | Solubility of other Amines<br>Amines having little or no solubility |
|---|---|
| 2-ethylhexanol | n-octylamine, ethylenediamine, tallowamine |
| cresylic acid | aniline |
| hexylene glycol | n-octylamine, ethylenediamine, tallowamine aniline |

We have found that the introduction of the above formulation directly into the liquid hydrocarbon medium, in an amount of from 1–10 moles based upon each mole of iron present in the liquid hydrocarbon medium is most effective.

After the formulation is added to and mixed with the liquid hydrocarbon, water is added to the resulting mixture in an amount of about 1–15% water based on the weight of the liquid hydrocarbon. Preferably, water is added in an amount of about 5–10 wt. %. The w/o (water-in-oil) emulsion thus formed is resolved with iron laden aqueous phase being separated. Reduced iron content hydrocarbon phase may be then subjected to further processing prior to end-use or it may be directly used for its intended end purpose as a fuel, etc.

Preferably, the emulsion is resolved in a conventional desalter apparatus. In typical desalters, optional pH operating conditions are maintained at from about 6–10 in order to retard corrosion and enhance emulsion resolution. Conventional desalters also utilize heat treatment and electric fields to aid in emulsion resolution. The methods of the present invention provide improvement in iron removal at such operating pHs and under the treatment conditions normally encountered in desalters.

The present invention has demonstrated effective removal of both iron naphthenate species from xylene and is therefore expected to function well with a host of liquid hydrocarbons and iron contaminants.

Although the invention has been generally described for use in conjunction with petroleum crudes, other environments are contemplated. In fact, the present invention is thought to be applicable to the extraction of iron from any iron containing liquid hydrocarbon. For example, in the manufacture of ethylene dichloride (EDC), ethylene is chlorinated with the use of an iron containing catalyst. Carryover of the iron containing catalyst with the desired product during product purification diminishes the value and performance of the ethylene dichloride.

EXAMPLES

In order to demonstrate the efficacy of the inventive method in extracting organic soluble iron species, the following evaluation was performed.

PROCEDURE

Unless otherwise noted, 95 ml (0.095 mmol or 0.000095 mol or $95\times10^{-6}$ or 56 ppm of Fe) of iron naphthenate in xylene (or crude oil), 5 ml of water, and the required amount of candidate extractant were added to each test flask and used for test purposes. The mixture of xylene and treatment was heated to 180° F. and maintained at that temperature for 20 minutes. Then, water was added and the resulting mixture was stirred for 20 more minutes. Stirring was stopped, the layers were allowed to separate, and the water layer was withdrawn from the bottom opening stopcock of each flask. The withdrawn water phase was then analyzed for iron content via a "wet procedure". A 2M HCl solution was used to perform two additional extractions on the remaining organic phase to remove the remaining iron so that a total iron balance could be calculated.

Percentage of Fe removal was calculated for each of the test runs. This figure represents the percent of iron extracted by one dosage of the candidate extractant. Fe balance is the total combined mols of iron extracted by the extractant and by the two HCl extractions and is always within 95±15 mmols.

In accordance with the "wet procedure" analytical method, an aliquot of the separated water phase from the flask (0.50 ml) was treated with 0.040 ml of 3% hydrogen peroxide, 3.0 ml of a saturated aqueous ammonium thiocyanate solution, and 4.0 ml of concentrated hydrochloric acid. It was then diluted to 100 ml hydrochloric acid. It was then diluted to 100 ml with deionized water. The percent transmittance of this solution at 460 nm in 2.5 cm cells was determined. Micromoles of Fe for each was then calculated in accordance with the equation $$u \text{ mol Fe} = \frac{\text{ml } H_2O \text{ in the extraction} \times (A\text{-}0.0315) \times 4.71}{\text{ml } H_2O \text{ water tested for Fe analysis}}$$

where A is the absorbance, numerical values derived from a standard curve generated by using a commercial iron standard of 1000 ppm diluted to 56 ppm.

The results of iron extractions with various EDTA formulae are shown in Table II.

TABLE II

Iron Extraction from a Xylene Solution of Iron Naphthenate (95 mL of 0.0010M) Using 5.0 mL of Water

| EDTA umol | Molar Ratio MOPA: EDTA | Solvent | Wt % EDTA in Formula | Temperature C | % Fe Extracted |
|---|---|---|---|---|---|
| 0 | 0 | — | 0 | 75 | 9 |
| 180 | 8.6 | CA | 7.7 | 25 | 10 |
| 180 | 8.6 | CA | 7.7 | 75 | 56 |
| 180 | 8.6 | CA | 7.7 | 75 | 33 |
| 180 | 8.6 | EH | 9.0 | 25 | 9 |
| 180 | 8.6 | EH | 9.0 | 75 | 12 |
| 200 | 8.6 | EH | 9.8 | 25 | 5 |
| 200 | 4 | EH | 9.8 | 75 | 7 |
| 220 | 4 | EG | 10.9 | 25 | 8 |
| 220 | 4 | EG | 10.9 | 75 | 16 |
| 230 | 4 | W | 9.8 | 75 | 10 |
| 200 | 4 | HG, W(a) | 9.8 | 75 | 14 |
| 200 | 4 | HG | 9.8 | 75 | 14 |
| 260(b) | 3 | CA | 10.0 | 75 | 19 |

(a)94% HG and 6% W (water)
(b)Nitrilotriacetic acid (NTA)
CA = cresylic acid EH = 2-ethylhexanol
EG = ethylene glycol HG = hexylene glycol The above results show the efficacy of the inventive formulation. What is especially surprising is the ability of the normally hydrocarbon insoluble aminocarboxylic acids, EDTA and NTA, to remove iron from the hydrocarbon medium. This result is achieved by the blending of the specific components of the inventive formulation.

What we claim is:

1. A method of extracting iron species from a liquid hydrocarbon medium comprising adding to the medium a composition comprised of about 2 to 20 weight percent of an amino carboxylic acid having the structure:

$$G_2-N\left[\overset{R}{\overset{|}{C}}H-(CH_2)_x-\overset{R'}{\overset{|}{C}}H-NG\right]_yG$$

where $G=CH_2COOH$, $x=0$ or 1, $y=0$ or 1 and R and R' may be the same or different and are H, $CH_3$ or $CH_2CH_2CH_2CH_2$, about 3 to 30 weight percent of methoxypropylamine and a solvent selected from the group consisting of 2-ethylhexanol, cresylic acid, ethylene glycol and hexyleneglycol, then adding water to the hydrocarbon medium to form an emulsion, separating the emulsion and removing iron-laden water from the separated emulsion wherein from about 1–10 moles of the composition is added to the hydrocarbon medium per mole of iron present in the hydrocarbon medium.

2. The method of claim 1 wherein the amino carboxylic acid is selected from the group consisting of ethylenediamine tetraacetic acid, nitrilotriacetic acid, (1,2-propylenedinitrilo)-N,N,N',N'-tetraacetic acid, (1,3-propylenedinitrilo)-N,N,N',N'-tetraacetic acid, (2,3-butylenedinitrilo)-N,N,N',N'-tetraacetic acid and (1,2-diaminocyclohexane)-N,N,N',N'-tetraacetic acid.

* * * * *